US011927009B2

(12) United States Patent
Dash et al.

(10) Patent No.: US 11,927,009 B2
(45) Date of Patent: Mar. 12, 2024

(54) CORRUGATED CONSTRUCTION ELEMENT

(71) Applicant: Saint-Gobain Placo, Suresnes (FR)

(72) Inventors: Girish Dash, Maharashtra (IN); Shailendra Shinde, Maharashtra (IN); Rizwan Ahmed, Maharashtra (IN)

(73) Assignee: Saint-Gobain Placo, Suresnes (FR)

( * ) Notice: Subject to any disclaimer, the term of this patent is extended or adjusted under 35 U.S.C. 154(b) by 0 days.

(21) Appl. No.: 16/615,565

(22) PCT Filed: Apr. 10, 2018

(86) PCT No.: PCT/IN2018/050205
§ 371 (c)(1),
(2) Date: Nov. 21, 2019

(87) PCT Pub. No.: WO2018/216028
PCT Pub. Date: Nov. 29, 2018

(65) Prior Publication Data

US 2020/0087913 A1 Mar. 19, 2020

(30) Foreign Application Priority Data

May 24, 2017 (IN) ..... 201741018271

(51) Int. Cl.

| | |
|---|---|
| ***E04C 2/32*** | (2006.01) |
| ***E04B 2/74*** | (2006.01) |
| ***E04B 2/78*** | (2006.01) |
| ***E04C 2/08*** | (2006.01) |

(52) U.S. Cl.
CPC ..... *E04C 2/322* (2013.01); *E04B 2/7457* (2013.01); *E04B 2/789* (2013.01); *E04C 2/08* (2013.01)

(58) Field of Classification Search
CPC ..... E04C 2/322; E04C 2/08; E04B 2/7457; E04B 2/789
See application file for complete search history.

(56) References Cited

U.S. PATENT DOCUMENTS

| | | | |
|---|---|---|---|
| 1,331,412 | A | 2/1912 | Brown |
| 2,664,179 | A | 12/1953 | Gwynne |

(Continued)

FOREIGN PATENT DOCUMENTS

| | | |
|---|---|---|
| CN | 101306277 | 11/2008 |
| DE | 2128588 | 1/1972 |

(Continued)

OTHER PUBLICATIONS www.rekreateddesign.com, "Herringbone vs. Chevron", Mar. 28, 2016, obtained from https://www.rekreateddesign.com/herringbone-vs-chevron/ (Year: 2016).*

(Continued)

*Primary Examiner* — Brian Handville
(74) *Attorney, Agent, or Firm* — McDonnell Boehnen Hulbert & Berghoff LLP

(57) ABSTRACT

A corrugated construction element (100) for drywall and ceiling construction is disclosed. The corrugated construction element (100) comprises a base profile (101) connected to at least one leg profile (102*a*) or (102*b*). The base profile (101) and/or at least one leg profile (102*a*) or (102*b*) comprise an array of angular corrugations (110) extending across their surface in a non-parallel direction to the principal axis L of the corrugated construction element (100). The disclosure also relates to an apparatus and a method for forming a corrugated profile (770).

18 Claims, 16 Drawing Sheets

(56) References Cited

U.S. PATENT DOCUMENTS

| | | | | |
|---|---|---|---|---|
| 3,165,815 | A | 1/1965 | Wogerbauer | |
| 3,243,930 | A | 4/1966 | Slowinski | |
| 4,016,700 | A | 4/1977 | Fasad | |
| 4,170,122 | A | 10/1979 | Cowell | |
| 4,709,517 | A | 12/1987 | Mitchell et al. | |
| 7,997,425 | B2 | 7/2011 | Golden | |
| 2007/0163191 | A1* | 7/2007 | Berry | E04B 2/7457 52/281 |
| 2008/0110126 | A1 | 5/2008 | Howchin | |
| 2008/0250738 | A1 | 10/2008 | Howchin | |
| 2015/0336143 | A1 | 11/2015 | Krautschick et al. | |

FOREIGN PATENT DOCUMENTS

| | | |
|---|---|---|
| EP | 0425952 | 5/1991 |
| EP | 2116658 | 11/2009 |
| GB | 429753 | 6/1935 |
| GB | 2171731 | 9/1986 |
| RU | 114981 | 4/2012 |
| WO | WO89/03920 | 5/1989 |
| WO | WO2008/087009 | 7/2008 |
| WO | WO2014/207159 | 12/2014 |

OTHER PUBLICATIONS

International Search Report for International Application No. PCT/IN2018/050205 dated Jul. 18, 2018, 6 pages.

Third Party Observation for International Application No. PCT/IN2018/050205 dated Sep. 12, 2019, 4 pages.

"Corrugate." Collins English Dictionary 2022. Web. https://www.collinsdictionary.com/dictionary/english/corrugate-(accessed Oct. 17, 2022), 5 pages.

* cited by examiner

CORRUGATED CONSTRUCTION ELEMENT

CROSS-REFERENCE TO RELATED APPLICATIONS

This application is a U.S. National Stage application of International Patent Application PCT/IN2018/050205, filed Apr. 10, 2018, which claims the benefit of priority of Indian Patent Application 201741018271, filed May 24, 2017.

TECHNICAL FIELD

The present disclosure relates, in general to a construction element, and more specifically to a corrugated construction element for drywall and ceiling construction/gypsum ceiling.

BACKGROUND

Drywall and gypsum ceilings generally make use of cold rolled metal sections that are made of plain metal sheet or knurled metal sheet (having dimples on it). These metal sections are formed by bending sheet material into desired shapes and typically comprise of an elongate base and a pair of side legs that extend on either side of the base in a perpendicular fashion. These metal sections are used as both vertical studs and horizontal channels or track. These channels and studs may be assembled into a frame and also secured to a corresponding floor, ceiling and the like. The frame may be covered with construction boards on one or both sides to form the wall or a ceiling. The plain or knurled metal sheet may be coated with a protective layer to reduce corrosion and other undesirable effects.

There are several advantages to using knurled metal sheets, compared to plain metal sheets. In order to increase the screw retention, a section may be formed from a metal sheet which is fully knurled or partially knurled. If the metal sheet is partially knurled, the positioning of the knurling can be selected so that the finished section contains knurling at the point where screws will be fixed.

In order to make sections with thin metal and therefore keep weight low, it is desirable to use thin metal. The thickness of sheet metal used to form drywall and gypsum ceiling sections is typically 0.4 mm to 1 mm, although other thicknesses may also be used. However, thin metal can result in metal sections with waviness in their shape. The waviness is overcome by providing certain reinforcing features/forms along the length of the section.

Knurled sheets are created by feeding the metal sheets between two mating rollers to create a dimpled surface. This process stretches the material in both directions (along the length and along the width). This causes cracks in any protective coating on the metal sheet and this can lead to corrosion over a period of time.

While the sections made from plain metal sheet suffer from quality issues such as waviness, twists, bending, less screw retention and stiffness, the knurled sections are prone to cracks and break due to the knurling process itself and have less perceived strength as compared to other sections and also suffer from quality issues due to excessive stretching of the metal. Therefore sections which overcome these disadvantages are required.

Metal profiles having longitudinal beads are known. The longitudinal beads are introduced on the base and/or the side legs connected to the base to reduce carrier-to-noise transmission (as shown in EP1124023) or for improving screw retention (as shown in PCT application 2010/008296). In U.S. publication number 2009/0038255 and 2009/0126315 beads extend in the longitudinal direction of the C-shaped profile and form support surfaces for planking.

These longitudinal beads discussed in the prior art references are provided locally on the base or side legs to improve the quality of the profiles like straightness, twist etc. However these locally provided beads do not increase the moment of inertia that contributes to the strength and stability of the profiles.

Thus it may be desirable to develop a construction element that overcomes the above mentioned quality issues and provides a crack/break resistant profile with improved screw retention, strength and one that withstands quality issues such as waviness, twisting and bending.

The present disclosure relates to a corrugated construction element provided with an array of angular corrugations extending across its surface in a non-parallel direction to the principal axis L of the corrugated construction element. The array of angular corrugations reduces deflection of the corrugated construction element under load conditions and improves screw retention and twist resistance.

SUMMARY OF THE DISCLOSURE

In one aspect of the present disclosure, a corrugated construction element for drywall and gypsum ceiling is disclosed. The corrugated construction element has a base profile connected to at least one leg profile and comprises an array of angular corrugations that extend across its surface in a non-parallel direction to the principal axis L of the corrugated construction element. The array of angular corrugations covers a surface area of at least 25% and less than or equal to 100% of the total surface area of the corrugated construction element.

In another aspect of the present disclosure, an apparatus for forming a sheet material into a profile having an array of angular corrugations extending across at least 25% of the surface of the profile is disclosed. The array of angular corrugations is comprised of at least a first set of angular corrugations and a second set of angular corrugations. The apparatus comprises a first roller having a first corrugation region for forming one part of a first set of angular corrugations (D1) and a second corrugation region for forming one part of a second set of angular corrugations (D2). The apparatus further comprises a second roller having a third corrugation region for forming the other part of the first set of angular corrugations (D1) and a fourth corrugation region for forming the other part of the second set of angular corrugations (D2). The angle between the first set of angular corrugations D1 and second set of angular corrugations D2 ranges between 30-150 degrees.

Other features and aspects of this disclosure will be apparent from the following description and the accompanying drawings.

BRIEF DESCRIPTION OF THE DRAWINGS

Embodiments are illustrated by way of example and are not limited to those shown in the accompanying figures.

Skilled artisans appreciate that elements in the figures are illustrated for simplicity and clarity and have not necessarily been drawn to scale. For example, the dimensions of some of the elements in the figures may be exaggerated relative to other elements to help to improve understanding of embodiments of the invention.

DETAILED DESCRIPTION

Wherever possible, the same reference numbers will be used throughout the drawings to refer to the same or similar parts. Embodiments disclosed herein are related to a corrugated construction element.

Figure 1:
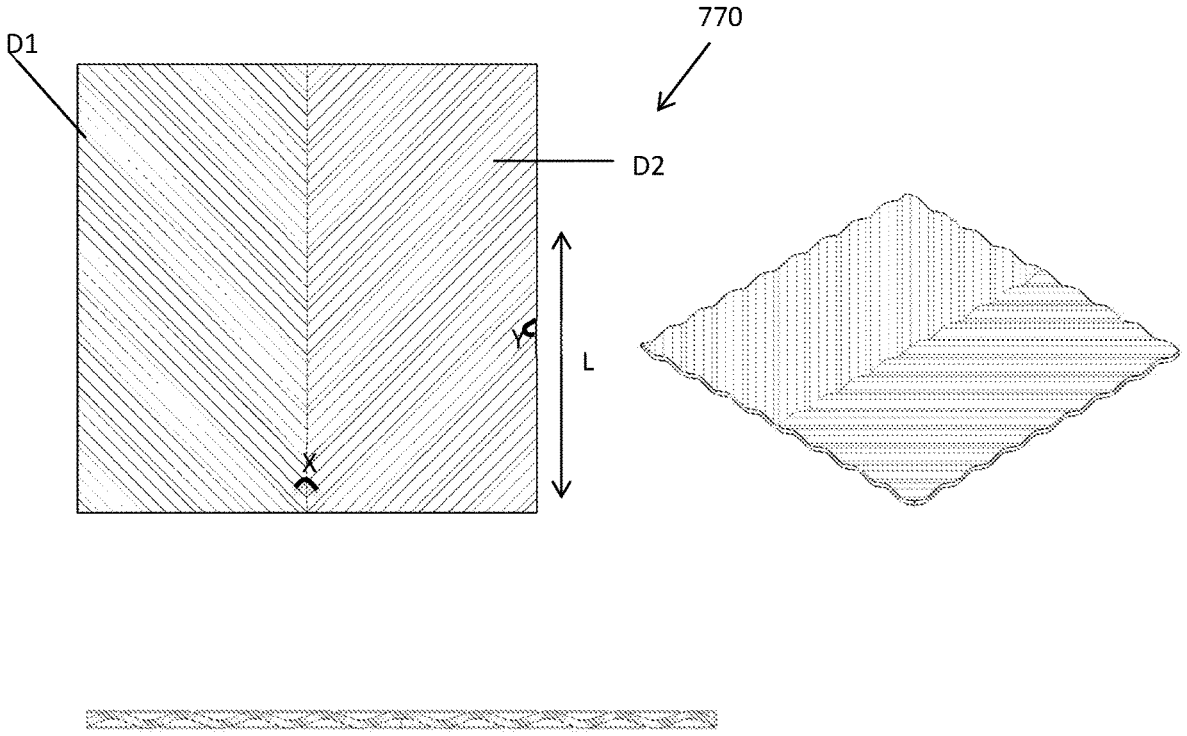
FIG. 1 illustrates a corrugated profile, according to one embodiment of the present disclosure.

FIG. 1 illustrates a sheet material comprising a corrugated profile 770, in accordance with an embodiment of the present disclosure. The corrugated profile 770 is formed from a flat sheet material 700. In one embodiment of the present disclosure, the sheet material is Galvanized Iron (G.I). The corrugated profile 770 is formed by passing the flat sheet material 700 between a pair of mating rollers comprising a first roller 610 and a second roller 620 (shown in FIG. 13) that rotate about their respective axes. The flat sheet material 700 when pressed between the rollers 610, 620 are deformed to carry a first set of angular corrugation D1 and a second set of angular corrugations D2 as shown in FIG. 1. The above process increases the effective thickness of the flat sheet material 700 such that the so obtained corrugated profile 770 has a thickness approximately twice that of the flat sheet material 700. The isometric view and the cross sectional view of the corrugated profile 770 clearly depict the increase in thickness of the sheet material 700 after passing through successive pair of mating roller 610, 620.

The first set of angular corrugation D1 and second set of angular corrugations D2 run angularly (at an angle Y from the principal axis of the corrugated profile L) from the edges of the corrugated profile 770 towards its center. Each angular corrugation from the first set of angular corrugations D1 meets with a corresponding angular corrugation from the second set of angular corrugations D2 to form an angle X between them. The angle X is measured in the plane of the corrugated profile 770. In one embodiment of the disclosure, the angle X between the first set of angular corrugations D1 and the second set of angular corrugations D2 ranges from 30° to 150°.

In one specific embodiment of the disclosure, the angle X between the first set of angular corrugations D1 and the second set of angular corrugations D2 is 90°. In one other embodiment, the angle X between the first set of angular corrugations D1 and the second set of angular corrugations D2 is 45°. The angle X between the first set of angular corrugations D1 and the second set of angular corrugations D2 may be varied between 30° and 150° depending on the desired strength and stiffness required for the wall or ceiling construction.

Figure 1A:
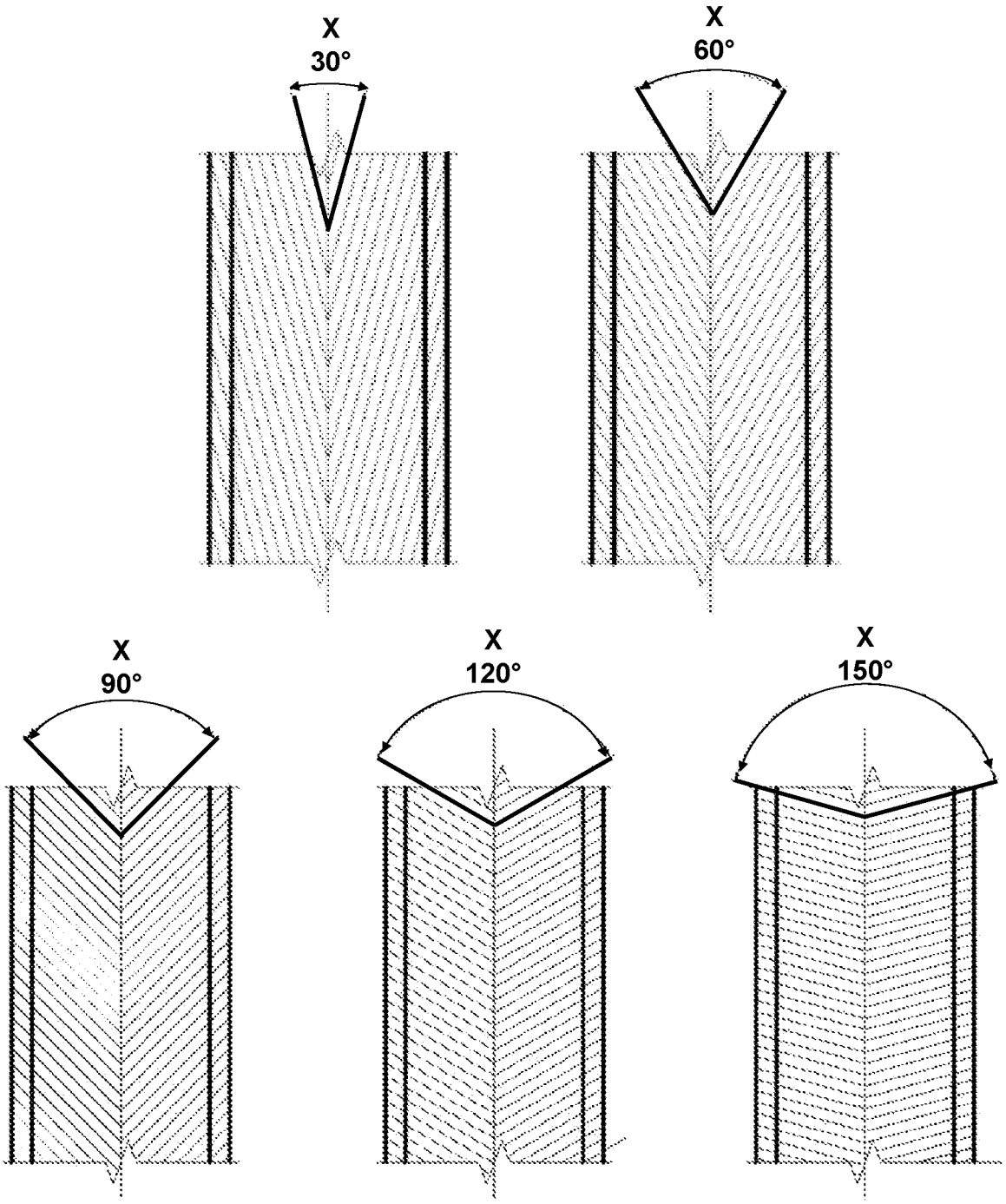
FIG. 1A illustrates corrugated profiles, according to other embodiments of the present disclosure.

FIG. 1A illustrates five sheet materials comprising a corrugated profile 770, where the angle X between the first set of angular corrugations D1 and the second set of angular corrugations D2 is 30°, 60°, 90°, 120° and 150°. The selection of the sheet material comprising corrugated profile 770 having a particular angle X depends on the desired strength and stiffness of the wall or ceiling construction.

In one embodiment of the present disclosure, the first set of angular corrugations D1 and second set of angular corrugations D2 cover a surface area greater than 25% and less than or equal to 100% of the total surface area of the corrugated profile 770. In one other embodiment, the first set of angular corrugations D1 and second set of angular corrugations D2 cover a surface area greater than 50% and less than or equal to 75% of the total surface area of the corrugated profile 770.

FIG. 1 depicts the corrugated profile 770 in a planar configuration. For applications in drywall and ceiling constructions, the corrugated profile 770 needs to be bent to desired shapes to form construction elements. The bending activity can be carried out using conventional bending tools and is done along the principal axis L of the corrugated profile 770. In multiple embodiments, the corrugated profile 770 is bent along the first set of angular corrugation D1 and/or along the second set of angular corrugation D2. In yet another embodiment, the corrugated profile 770 is bent along the line bisecting the corrugated profile 770 where the first set of angular corrugation D1 meets the second set of angular corrugation D2. Such bending(s) results in corrugated construction elements 100 that will be described in detail in the following embodiments.

Figure 2:
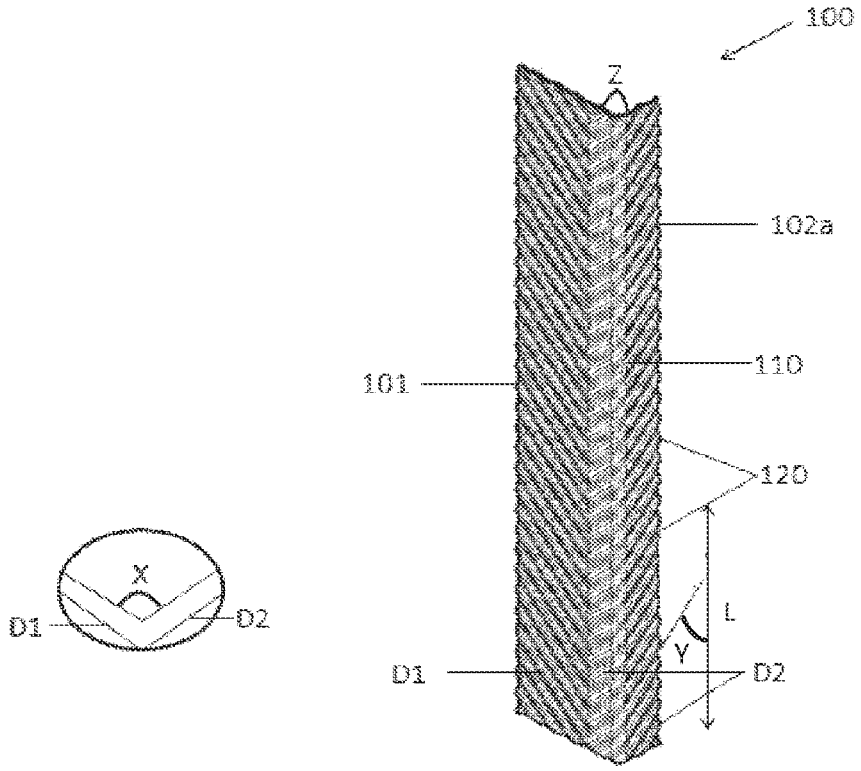
FIG. 2 illustrates a perspective view of a corrugated construction element, according to an embodiment of the present disclosure.

FIG. 2 illustrates an exemplary corrugated construction element 100, in accordance with an embodiment of the present disclosure. The corrugated construction element 100 is formed by bending the planar corrugated profile 770 along a line parallel to the principal axis L of the corrugated profile 770. In the specific embodiment shown in FIG. 2 the corrugated profile 770 is bent along a line that is not located along the center of the corrugated profile 770. In other embodiments the corrugated profile 770 may be bent along a line that is parallel to the principal axis L and positioned anywhere on the surface of the corrugated profile 770, including along the center of the corrugated profile 770. As shown, the corrugated construction element 100 includes a base profile 101 connected to a first leg profile 102*a*, according to an embodiment of the present disclosure. The first leg profile 102*a* is non-coplanar to the base profile 101. The base profile 101 forms an opening angle Z with the first leg profile 102*a*. In one embodiment of the disclosure, the angle Z is less than or equal to 90°. In another embodiment, the angle Z is greater than or equal to 90°. The exemplary corrugated construction element 100 shown in FIG. 2 has an opening angle Z equal to 90°.

The base profile 101 and the first leg profile 102*a* comprise an array of angular corrugations 110. The array of angular corrugations 110 comprises V-shaped grooves 120. The array of angular corrugations 110 extends across the surface of the corrugated construction element 100 in a non-parallel direction to the principal axis L of the corrugated construction element 100. In one embodiment of the disclosure, the array of angular corrugations 110 covers a surface area greater than 25% and less than or equal to 100% of the total surface area of the corrugated construction element 100. In one other embodiment of the disclosure, the array of angular corrugations 110 covers a surface area greater than 50% and less than or equal to 75% of the total surface area of the corrugated wall construction element 100. In yet another embodiment of the present disclosure, the array of angular corrugations 110 is continuous throughout the surface area of the corrugated construction element 100.

The array of angular corrugations 110 is V-shaped with the bottom of the V-shaped being pointed as shown in FIG. 2, according to one embodiment of the disclosure. In another embodiment of the disclosure, the array of angular corrugations 110 is V-shaped with the bottom of the V-shaped being curved. The array of angular corrugations 110 as shown in FIG. 2 is comprised of two parts viz., a first set of angular corrugations D1 and second set of angular corrugations D2. The first set of angular corrugations D1 and the second set of angular corrugations D2 run in opposite directions from the edges of the corrugated construction element 100 so that each angular corrugation from the first set of angular corrugations D1 meets with a corresponding angular corrugation from the second set of angular corrugations D2 to form an angle X between them. In one specific embodiment of the disclosure, the angle X between the first set of angular corrugations D1 and the second set of angular corrugations D2 is 90°. In one other embodiment, the angle X between the first set of angular corrugations D1 and the second set of angular corrugations D2 is 45°.

FIG. 2 also shows an enlarged portion of the corrugated construction element 100, where one angular corrugation from the first set D1 meets with a corresponding angular corrugation from the second set D2 at an angle X.

In the embodiment shown in FIG. 2, the set of angular corrugations D1 and the set of angular corrugations D2 meet on the base profile 101. The set of angular corrugations D1 and the set of angular corrugations D2 may meet at any position on the base profile 101. In other embodiments the set of angular corrugations D1 and the set of angular corrugations D2 meet on a leg profile or along the joint between the base profile and the leg profile.

The array of angular corrugations 110 extending on the first leg profile 102*a* has an angle Y from the principle axis L of the corrugated construction element 100. In one embodiment of the disclosure, the angle Y between the principle axis L of the corrugated construction element 100 and the angular corrugations 110 on the first leg profile 102*a* ranges from 15° to 75°. In one specific embodiment, the angle Y between the principle axis L of the corrugated construction element 100 and the angular corrugations 110 on the first leg profile 102*a* is 45°. This exemplary corrugated construction element 100 shown in FIG. 2 is used as a ceiling angle for ceiling constructions.

In one embodiment of the present disclosure, the angle X lies in the base profile 101 and the angle Y lies in the first leg profile 102*a*. In such a case the base profile 101 is provided with a first set of angular corrugations D1 and a second set of angular corrugations D2, while the first leg profile 102*a* is provided with only the second set of angular corrugations D2 (as shown in FIG. 2). However in an alternative embodiment, the angle of X may lie in the first leg profile 102*a*. In such a case the first leg profile 102*a* is provided with the first set of angular corrugations D1 and the second set of angular corrugations D2, while the base profile 101 is provided with only the second set of angular corrugation D2. In an alternative embodiment, the angle X may lie along the joint between the base profile 101 and the first leg profile 102*a*. In such an embodiment, the base profile 101 is provided with the first set of angular corrugations D1 and the first leg profile 102*a* is provided with the second set of angular corrugations D2. In one other alternative embodiment, there may be two pairs of angular corrugations (D1 and D2, D1' and D2'), such that D1 and D2 meet at an angle of X along the base profile 101 and D1' and D2' meet at the angle of X' along the first leg profile 102*a*. Angles X and X' could be the same or different from each other. In further embodiments in which there are two pairs of angular corrugations, the pairs of angular corrugations may meet at any position on the base profile, the leg profiles or the joint between the base profile and the leg profile.

Angles X and Y may be adjusted in order to obtain desired stiffness and strength. Although the present disclosure in specific embodiments teaches one or more examples of angles X and Y, alternations to angles X and Y within the claimed ranges should be understood to be encompassed within the scope of the present disclosure.

Figure 3:
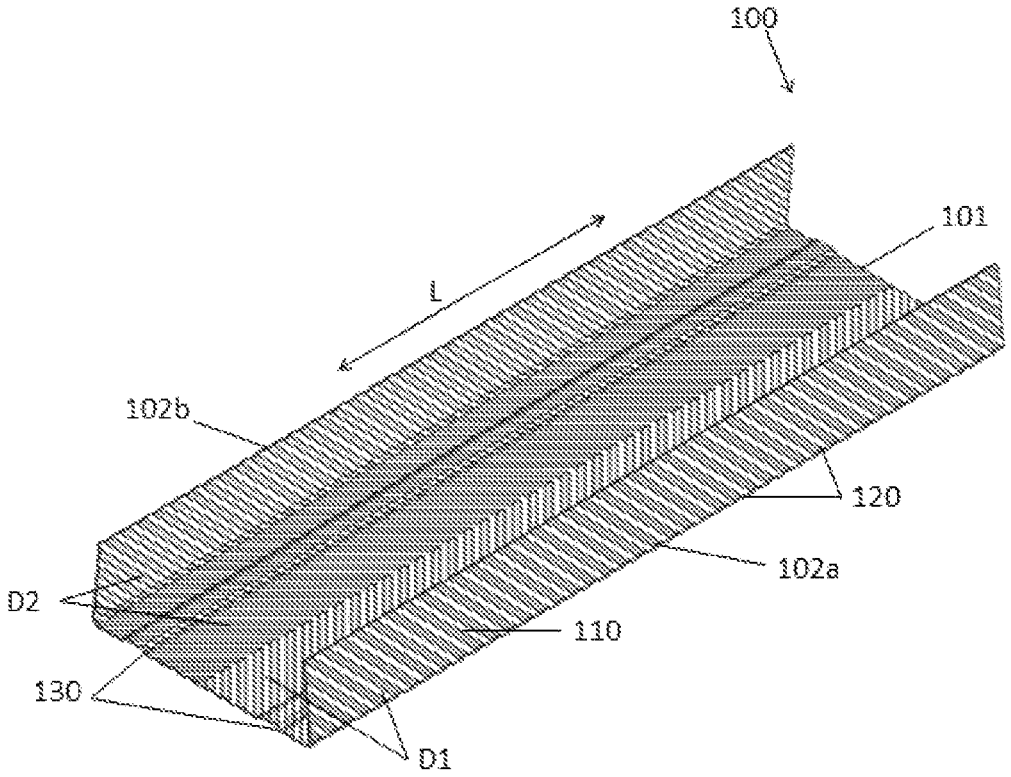
FIG. 3 illustrates a perspective view of a corrugated construction element, according to another embodiment of the present disclosure.

Referring to FIG. 3 is a corrugated construction element 100 according to one other embodiment of the present disclosure. The corrugated construction element 100 is formed by bending the planar corrugated profile 770 along a first line that is parallel to the principal axis L and which bisects the first set of angular corrugations D1 and also a second line that is parallel to the principal axis L and which bisects the second set of angular corrugations D2. In the illustrated embodiment of FIG. 3, the corrugated construction element 100 comprises a base profile 101 connected to a first leg profile 102*a* and a second leg profile 102*b*. The first leg profile 102*a* and the second leg profile 102*b* are non-coplanar to the base profile 101 and have an opening angle Z equal to 90°. The corrugated construction element 100 may optionally comprise longitudinal beads 130 running along the length of the corrugated construction element 100 on the base profile 101. The longitudinal beads 130 are provided to increase strength, stiffness and avoid waviness and twisting of the corrugated construction element 100. This exemplary corrugated construction element 100 shown in FIG. 3 is used as a floor channel for drywall constructions.

In the corrugation construction element 100 depicted in this figure, the angle X lies in the base profile 101 and angle Y lies in the first leg profile 102*a* and second leg profile 102*b*. The base profile 101 comprises both the first set of angular corrugations D1 and second set of angular corrugations D2. The first leg profile 102*a* is provided with only the first set of angular corrugations D1 and the second leg profile 102*b* is provided with only the second set of angular corrugations D2. In one other alternative embodiment, sets of angular corrugations may meet along the base profile 101 and also along the leg profiles 102*a*, 102*b*. In such an embodiment, the corrugated construction element 100 comprises three pairs of sets of angular corrugations (D1 and D2; D1' and D2'; D1", and D2"). In such an embodiment, D1 and D2 meet at angle X, D1' and D2' meet at angle X' and D1" and D2" meet at angle X".

Figure 4A:
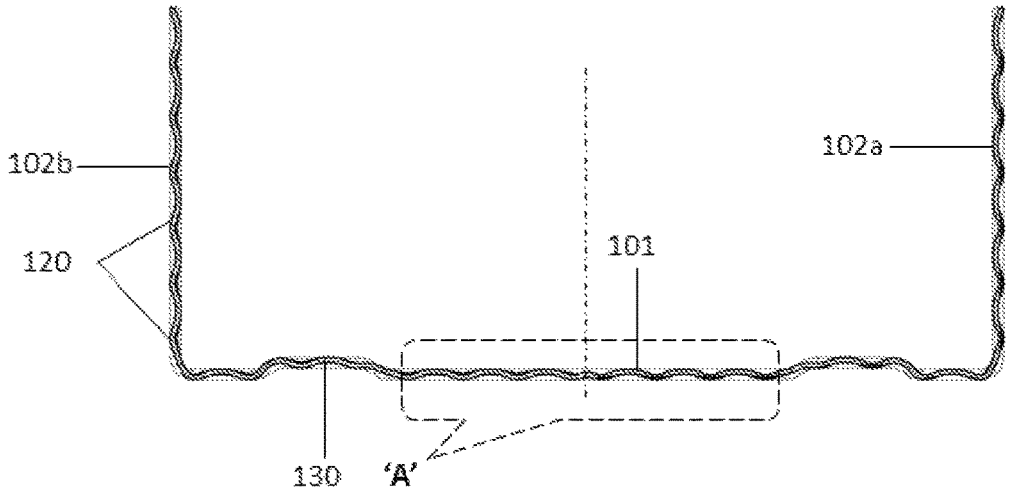
FIG. 4A illustrates a cross-sectional view of a corrugated construction element, according to an embodiment of the present disclosure.
Figure 4B:
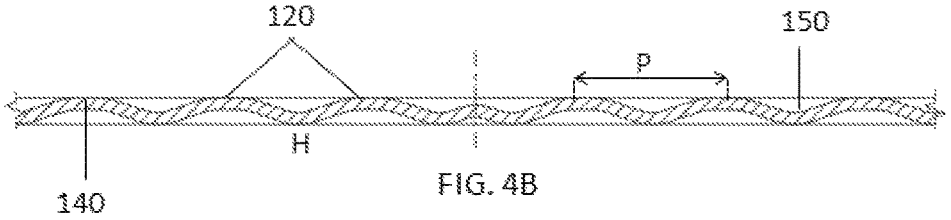
FIG. 4B illustrates a enlarged view of portion 'A' of FIG. 4A, showing a corrugated construction element, according to an embodiment of the present disclosure.

Illustrated in FIG. 4A is a cross sectional view of the corrugated construction element 100 shown in FIG. 3. The array of angular corrugations 110 comprising V-shaped grooves 120 is clearly depicted on the base profile 101, first leg profile 102*a* and the second leg profile 102*b*. The longitudinal grooves 130 are also seen on the base profile 101. FIG. 4B depicts an enlarged view of portion 'A' of FIG. 4A, wherein the V-grooves 120 of the angular corrugations 110 each comprising a peak 140 and trough 150 can be seen. In multiple embodiments of the present disclosure, the peaks 140 and troughs 150 of the V-shaped grooves 120 is sharp or blunt or curved.

The array of angular corrugations 110 provided on the corrugated construction element 100 has a pitch P—this is the distance between two consecutive peaks 140 or troughs 150 of the V-shaped grooves 120. In multiple embodiments of the present disclosure, the pitch P ranges between 2 mm and 6 mm. The array of angular corrugations 110 provided on the corrugated construction element 100 has a height H. In multiple embodiments of the present disclosure, the height 'H' ranges between 0.1 mm and 1 mm.

Figure 5:
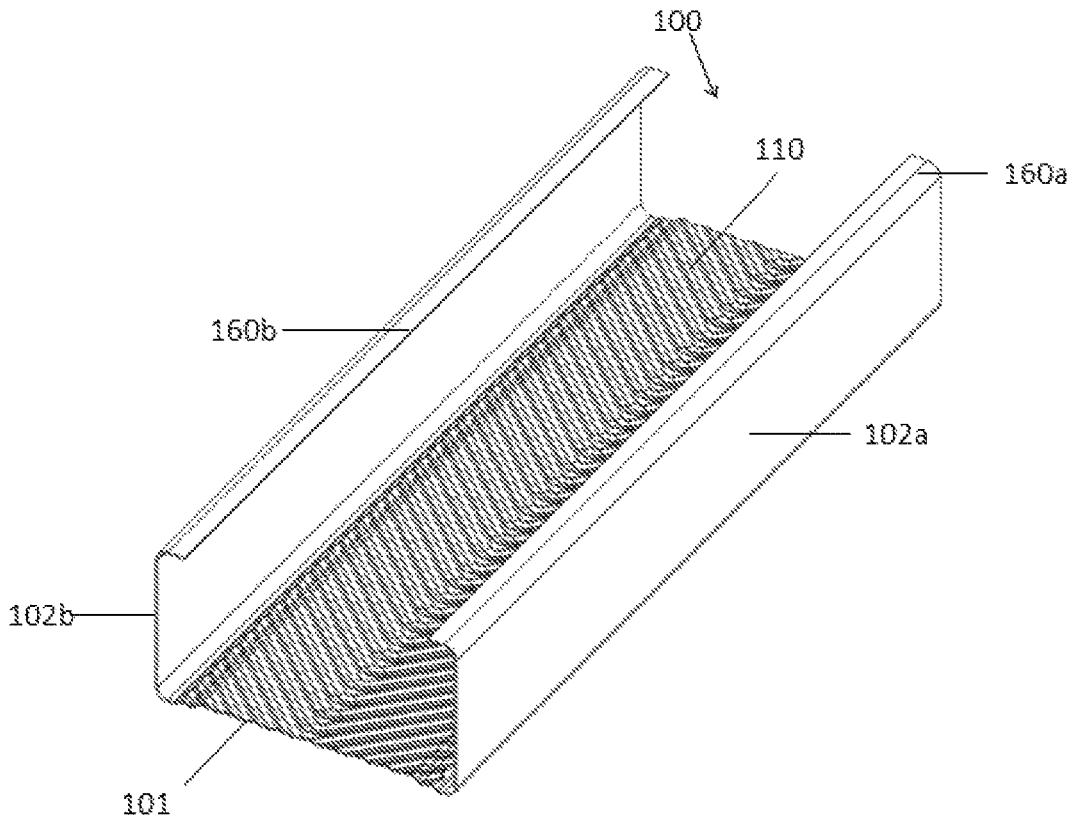
FIG. 5 illustrates a corrugated construction element, according to another embodiment of the present disclosure.

In various embodiments of the present disclosure, the array of angular corrugations 110 may be provided only on the base profile 101 or only on the first leg profile 102*a* or only on the second leg profile 102*b* or combinations thereof. The exemplary corrugated construction element 100 depicted in FIG. 5 comprises an array of angular corrugations 110 only on the base profile 101. The first set of angular corrugations D1 and the second set of angular corrugations D2 form an angle X at the center of the base profile 101. The first set of angular corrugations D1 and the second set of angular corrugations D2 do not extend beyond the base profile 101 and hence the first leg profile 102*a* and second leg profile 102*b* are devoid of any corrugations. The first leg profile 102*a* and second leg profile 102*b* as shown in FIG. 5 terminate with inward flange profiles 160*a* and 160*b*, respectively. The flange profiles 160*a* and 160*b* overlie the base profile 101 and are parallel to each other. The flange profiles 160*a* and 160*b* may optionally be included or excluded from any of the embodiments of the present disclosure.

Figure 6:
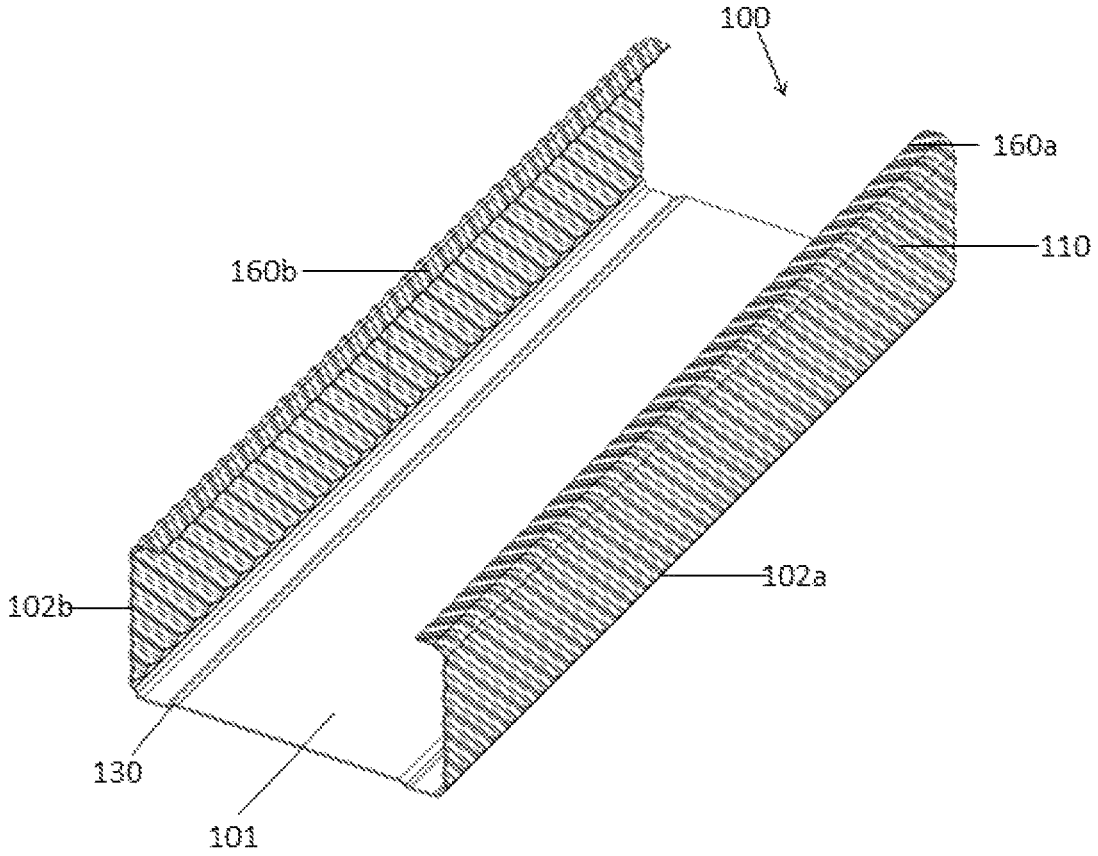
FIG. 6 illustrates a corrugated construction element, according to another embodiment of the present disclosure.

The exemplary corrugated construction element 100 depicted in FIG. 6 comprises an array of angular corrugations 110 on the first leg profile 102*a* and second leg profile 102*b*. The base profile 101 is free of any corrugations. The first set of angular corrugations D1 on the first leg profile 102*a* and second set of angular corrugations D2 on the second leg profile 102*b* do not meet with each other to form angle X. The inward flange profiles 160*a* and 160*b* of the first leg profile 102*a* and second leg profile 102*b* respectively, are also seen provided with the array of angular corrugations 110.

Figure 7:
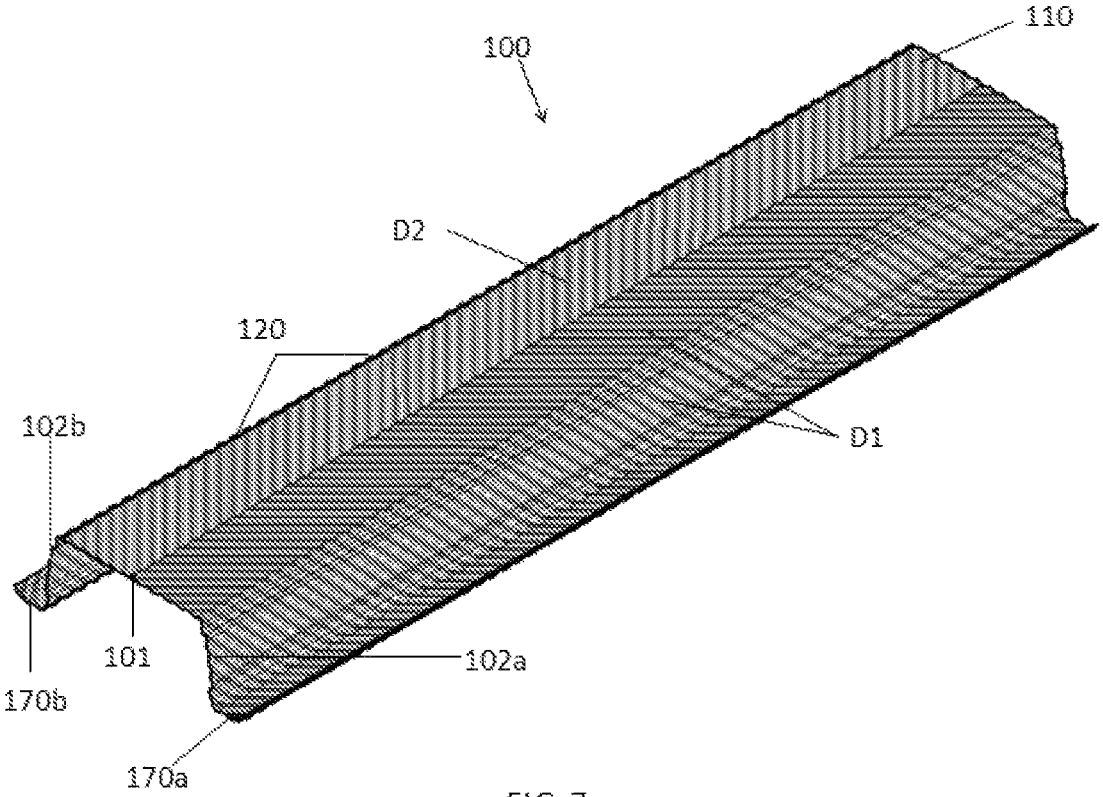
FIG. 7 illustrates a corrugated construction element, according to another embodiment of the present disclosure.

Illustrated in FIG. 7 is another exemplary corrugated construction element 100 used for ceiling construction, according to one embodiment of the present disclosure. The corrugated construction element 100 is formed by bending the planar corrugated profile 770 along a first line that is parallel to the principle axis L and which bisects the first set of angular corrugation D1 and along a second line that is parallel to the principle axis L and which bisects the second set of angular corrugation D2. The depicted corrugated construction element 100 comprises a base 101 connected to a first leg profile 102*a* and a second leg profile 102*b* at an opening angle Z greater than 90°. The first leg profile 102*a* and second leg profile 102*b* terminate with outward flange profiles 170*a* and 170*b*, respectively. The outward flange profiles 170*a* and 170*b* lie outside the base profile 101 and are parallel to each other. The base profile 101, first and second leg profile 102*a*, 102*b* and out-turned flange profiles 170*a*, 170*b* are all provided with the array of angular corrugations 110. The flange profiles 170*a* and 170*b* may optionally be included or excluded from any of the embodiments of this invention.

Figure 8:
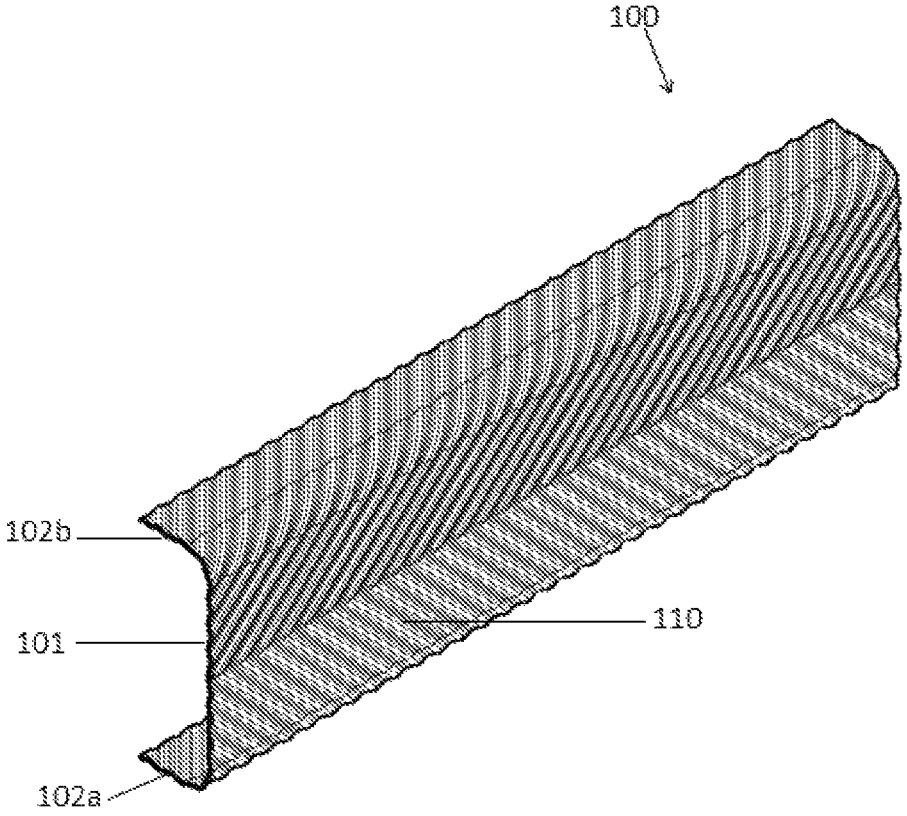
FIG. 8 illustrates a corrugated construction element, according to another embodiment of the present disclosure.

Illustrated in FIG. 8 is another exemplary corrugated construction element 100 used as an intermediate channel for drywall construction, according to one embodiment of the present disclosure. The corrugated construction element 100 is formed by bending the planar corrugated profile 770 along a first line that is parallel to the principle axis L and which bisects the first set of angular corrugation D1 and along a first second line that is parallel to the principle axis L and which bisects the second set of angular corrugation D2. The first leg profile 102*a* and second leg profile 102*b* of the corrugated construction element 100 has a height 'G' which according to multiple embodiments of the present disclosure is equal to or variable from each other. In specific embodiments of the present disclosure, the height 'G' of the first leg profile 102*a* is greater than that of the second leg profile 102*b* or vice versa.

Figure 9:
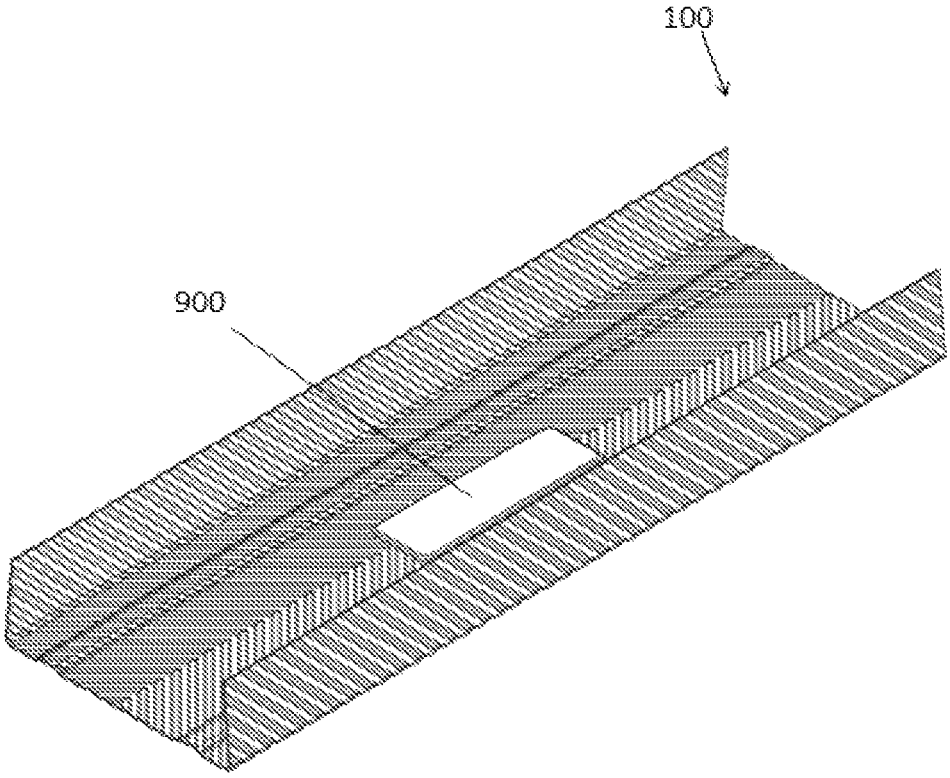
FIG. 9 illustrates a corrugated construction element, according to another embodiment of the present disclosure.

FIG. 9 illustrates another exemplary corrugated construction element 100, according to one embodiment of the present disclosure. Herein the corrugated construction element 100 comprises a flat portion 900. In one embodiment, the flat portion 900 is used to emboss a trademark, a name of a product or other information related to the corrugated construction element 100.

Figure 10:
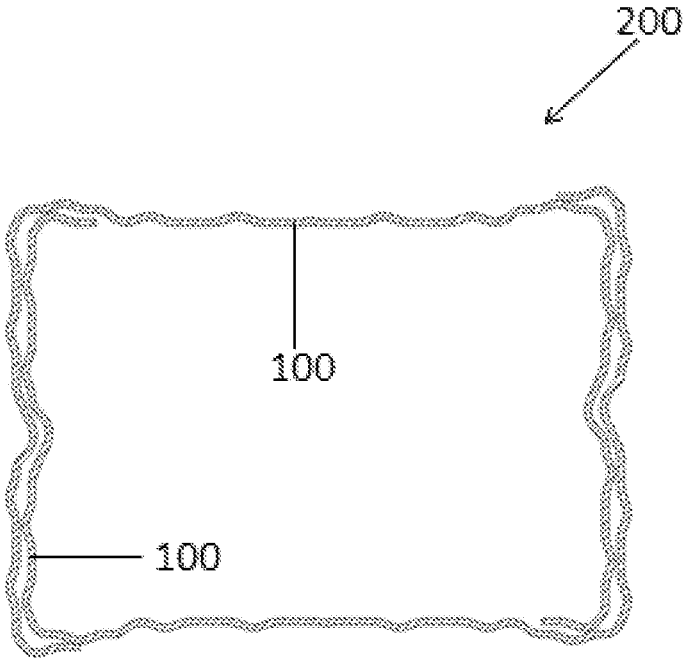
FIG. 10 illustrates a cross section of two identical corrugated construction elements joined to form a rectangular corrugated construction element, according to one embodiment of the present disclosure.

In one embodiment, as depicted in FIG. 10 two corrugated construction elements 100 with variable height 'G' can be joined to form a rectangular corrugated construction element 200. The rectangular corrugated construction element 200 form a boxed configuration that increases the strength and stability of the wall system constructed from such configuration.

Figure 11:
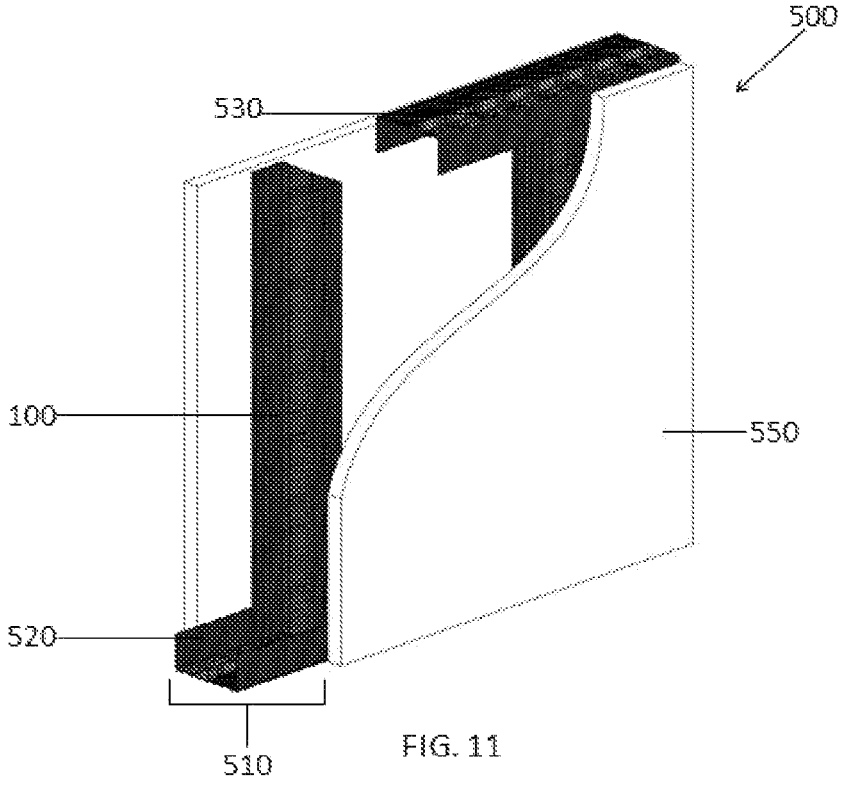
FIG. 11 illustrates a schematic view of a wall construction incorporated with corrugated construction elements, according to one embodiment of the present disclosure.

The disclosure also relates to a wall construction comprising a frame assembly configured from a plurality of corrugated construction elements 100. The wall may be a drywall. Illustrated in FIG. 11 is a wall construction 500 comprising a frame 510. The frame 510 includes two channels, namely a floor channel 520 on the bottom and a ceiling channel 530 on the top. The floor channel 520 and ceiling channel 530 have the configuration of a corrugated construction element 100, according to one embodiment of the present disclosure. The frame 510 also includes a plurality of corrugated construction elements 100 supported by the floor channel 520 and ceiling channel 530.

The floor channel 520 and ceiling channel 530 are spaced apart from each other. A plurality of corrugated construction elements 100 are configured to be disposed in each of the floor channel 520 and ceiling channel 530. One end of each of the corrugated construction element 100 is disposed in the floor channel 520 and a second end opposite to the first end of each of the corrugated construction element 100 is disposed in the ceiling channel 530. The corrugated construction elements 100 are spaced apart from each other in the frame 510. In one embodiment of the present disclosure, the corrugated construction elements 100 are equidistantly spaced from each other.

Various parameters related to the corrugated construction elements 100, such as, the number of the corrugated construction element 100 in the frame 510, the width of the corrugated construction element 100, height 'G' of the first and second leg profiles 102*a*, 102*b* of the corrugated construction element 100, vertical length of the corrugated construction element 100, cross-section of the corrugated construction element 100, spacing of the corrugated construction element 100 may suitably vary based on the type of application. For example, the parameters related to the corrugated construction elements 100 may depend on the size of the wall 500 required for the application, strength of the wall 500 etc.

The wall 500 may include construction boards 550 coupled to the frame 510. In one example, the construction board 550 may be a gypsum board. In an embodiment, the construction board 550 may be attached to the frame 510 on one or more sides thereof. In a preferred embodiment, the construction board 500 may be attached to the corrugated construction elements 100 of the frame 510. Any suitable fastening mechanisms, for example, screws, adhesives etc. may be used to accomplish the coupling between the frame 510 and the construction boards 550, as applicable. Further, a suitable jointing method may be used to attach the construction boards 550 to each other.

In an example, the construction board 550 may be reinforced and may include a polymeric binder and a plurality of fibres. The plurality of fibres may include glass fibres, synthetic polymer fibres or natural fibres, either separately or in combination. Further, the polymeric binder may include any of starch, synthetic material etc. In various other embodiments, the construction board 550 may include any other material such as, but not limited to, MDF, plywood, glass, metal sheet, cement, fiber cement, plastic sheet or a combination thereof.

The construction wall 500 may also include one or more insulation elements (not shown). In one embodiment, the insulation element is disposed between the frame 510 and the construction board 550. In other embodiments, the insulation element is disposed at other locations in the wall 500 based on the specific type of application. In various examples, the insulation element may include a foam material or other materials to provide any of acoustic properties, strength or other properties to the wall 500. Alternatively, the wall 500 may be configured without an insulation element.

Figure 12:
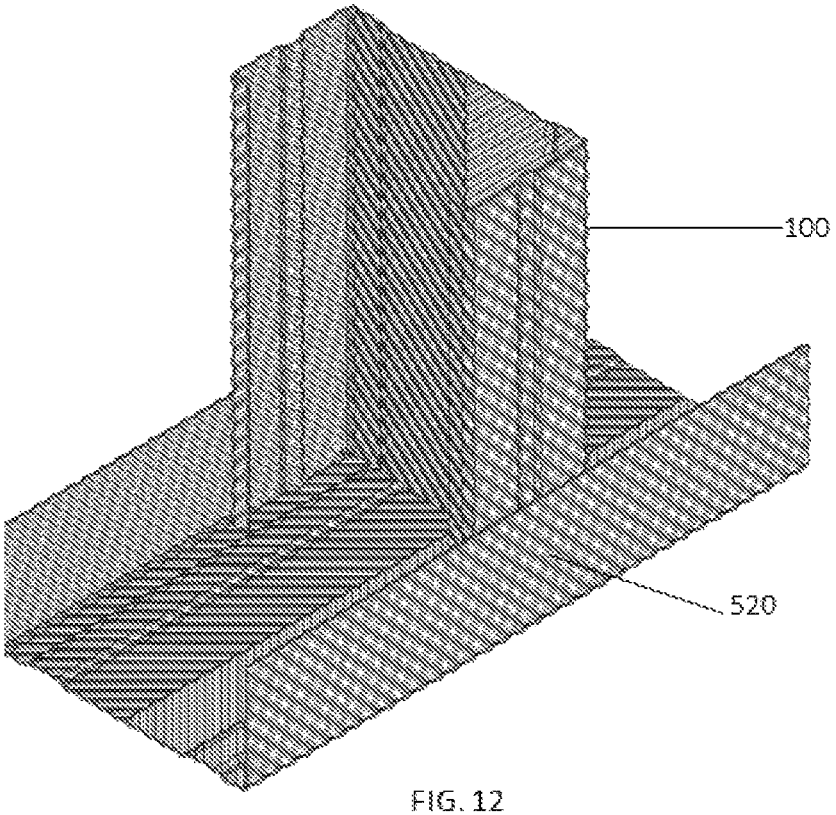
FIG. 12 illustrates a corrugated construction element being supported in a floor channel, according to one embodiment of the present disclosure.

The array of angular corrugations 110 increases the screw retention properties of the corrugated construction elements 100 for screwing the construction boards 550 to the frame 510. In some embodiments the angle Y of the angular corrugations 110 on the first and second leg profiles 102*a*, 102*b* of the floor channel 520 and ceiling channel 530 correspond to that on the vertically disposed corrugated construction elements 100 and hence help in interlocking the corrugated construction elements 100 between the floor channel 520 and the ceiling channel 530. This interlocking may help to secure the vertical element within the channel without the need for crimping, screwing or other techniques used to prevent the vertical element from moving within the channel. In the illustrated embodiment of FIG. 12, the floor channel 520 supporting the corrugated construction element 100 is illustrated. The corrugated construction element 100 is interlocked in the floor channel 520 as shown in the figure.

In one embodiment of the present disclosure, the corrugated construction elements 100 are fastened to the base profile 101 of the floor channel 520. In an example, mechanical fasteners such as, bolts, screws and the like may be used to fasten the corrugated construction elements 100 to the floor channel 520.

The present disclosure also relates to an apparatus for forming a sheet material into a corrugated profile comprising an array of angular corrugations 110. The corrugated construction element 100 of the present disclosure is formed from a flat sheet material 700. The flat sheet material 700 is typically passed through a series of consecutive pair of rollers to form a corrugated profile on the sheet material. In one embodiment of the present disclosure, the array of angular corrugations 110 extends over at least 25% of the surface area of the profile.

Figure 13:
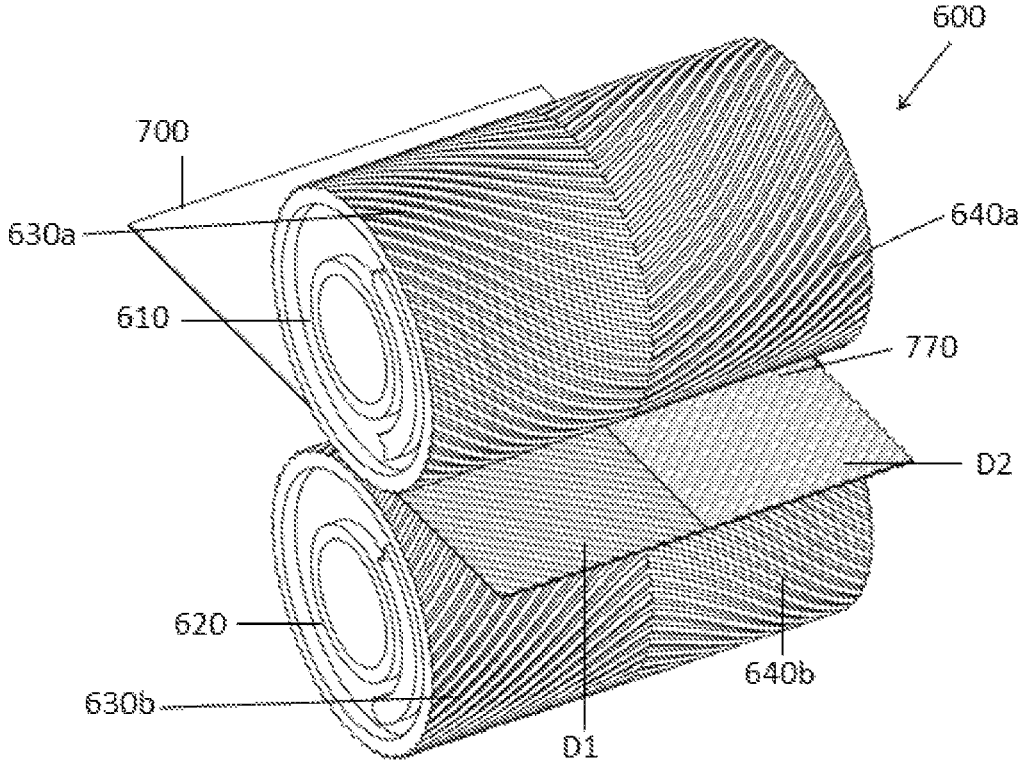
FIG. 13 illustrates an apparatus for forming a sheet material into a profile comprising an array of angular corrugations, according to one embodiment of the present disclosure.

Illustrated in FIG. 13 is an apparatus 600 for forming a sheet material 700 into a corrugated profile 770. The apparatus 600 comprises a first roller 610 and a second roller 620 that mate with each other contra rotating about their respective axes. The first roller 610 comprises a first corrugation region 630*a* and a second corrugation region 640*a*. The first corrugation region 630*a* forms one part of the first set of angular corrugations D1 and the second corrugation region 640*a* forms one part of the second set of angular corrugations D2.

The second roller 620 comprises a third corrugation region 630*b* and a fourth corrugation region 640*b*. The third corrugation region 630*b* forms the other part of the first set of angular corrugations D1 and the fourth corrugation region 640*b* forms one part of the second set of angular corrugations D2. The first corrugation region 630*a* and third corrugation region 630*b* are co-operable and comprise V-shaped grooves 120 that correspond with each other. Similarly, the second corrugation region 640*a* and fourth corrugation region 640*b* are co-operable and comprise V-shaped grooves 120 that correspond with each other.

In an alternate embodiment, the first roller 610 and second roller 620 may have multiple sets of first, second, third and fourth corrugation regions (630*a*, 630*b*, 640*a* and 640*b*). For example a first roller and a second roller comprising three sets of first, second, third and fourth corrugation regions viz., $\mathbf{630}a_1$, $\mathbf{630}b_1$, $\mathbf{640}a_1$ and $\mathbf{640}b_1$; $\mathbf{630}a_2$, $\mathbf{630}b_2$, $\mathbf{640}a_2$ and $\mathbf{640}b_2$; and $\mathbf{630}a_3$, $\mathbf{630}b_3$, $\mathbf{640}a_3$ and $\mathbf{640}b_3$ would produce a corrugated profile 770 with three pairs of sets of angular corrugations (D1 and D2, D1' and D2', D1" and D2"). When bent into shape, such a corrugated profile would have three pairs of sets of angular corrugations such that one pair (D1 and D2) is on the base profile with angle X between them, one pair (D1' and D2') is on the first leg profile with angle X' between them and one pair (D1" and D2") is on the second leg profile with angle X" between them. Angles X, X' and X" could be the same or different from each other.

Passage of the flat sheet material 700 through the successive pairs of rollers causes the angular corrugations on the base profile 101, first leg profile 102*a*, second leg profile 102*b* and flange profiles 160 (160*a*, 160*b*), 170 (170*a*, 170*b*). The pair of rollers 610 and 620 stretch the sheet material angularly and effectively increases (doubles) the thickness of the sheet material. The height 'H' and pitch P of the array of angular corrugations created on the sheet material depends on the initial thickness of the sheet material.

For example, a flat sheet material 700 having a thickness of 0.5 mm when passed through the mating rollers 610, 620 will form a corrugated profile 770 having a thickness of lmm Such a corrugated profile 770 will have a pitch P of 3.5 mm. Similarly, a flat sheet material 700 having a thickness of 0.9 mm when passed through the mating roller 610, 620 will form a corrugated profile 770 having a thickness of 1.8 mm Such a corrugated profile 770 will have a pitch P of 4.5 mm

EXAMPLES

To demonstrate reduced deflection of the corrugated construction element 100 of the present disclosure, comparative studies were carried out as described below.

All comparative examples described below present the results of simulations of three different construction elements:

(1) a construction element comprising linear corrugations;

(2) a construction element comprising square indentations; and (3) a corrugated construction element 100 comprising angular corrugations in accordance with the present disclosure.

The simulated construction element with linear corrugations comprises corrugations extending over the entire surface of the construction element. The linear corrugations are parallel to the principle axis of the construction element (e.g. parallel to the longest dimension of the construction element) and have a pitch of 3.5 mm and a depth of 0.5 mm.

Figure 14:
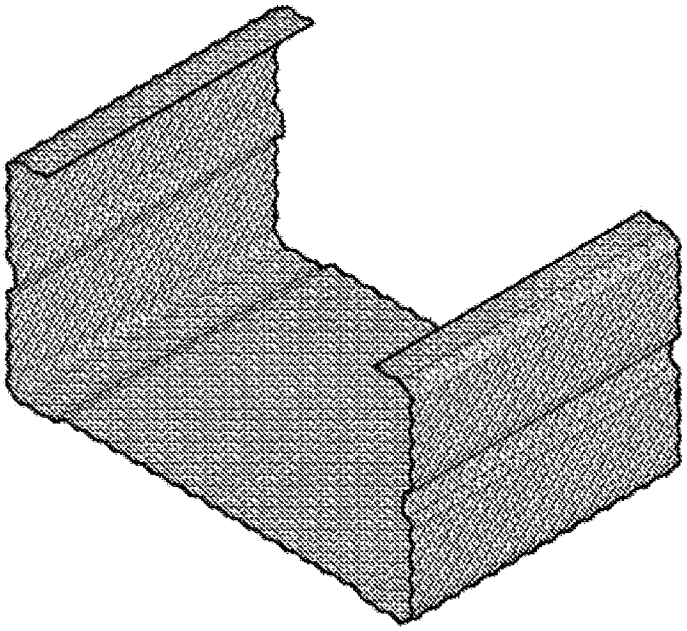
FIG. 14 illustrates a portion of a section provided with small square indentations covering the entire surface of the section.

The simulated construction element with square indentations comprises small square indentations covering the entire surface of the construction element. The small square indentations were created having a pitch of 3.3 mm, a diameter of 1.5 mm and a depth of 0.5 mm. An illustration of a portion of the surface of such a construction element with square indentations is shown in FIG. 14.

The simulated corrugated construction element 100 in accordance with the present disclosure comprises angular corrugations over the entire surface of the construction element. The angle between the corrugations and the principle axis of the construction element was 45°. The corrugations have a pitch of 3.5 mm and a depth of 0.5 mm.

Each simulated construction element is 300 mm long. Unless specified, all other parameters (e.g. dimensions and geometry) were the same for each simulated construction element.

Comparative Example 1

Figure 15A:
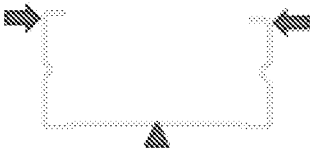
FIG. 15A demonstrates simulation of deflection under lateral load condition.

Simulations of deflection under lateral load condition were compared for the three construction elements described above. In the simulation, a load of 0.5 kg was applied on both the leg profiles (as shown in FIG. 15A) of the three construction elements described above. The results are shown in Table 1. The results showed that the corrugated construction element 100 of the present disclosure had least deflection value and hence was stronger.

TABLE 1

| Deflection under Lateral Load Condition | | | |
|---|---|---|---|
| | Sample/Test Condition | | |
| | Construction Element with Linear Corrugations | Construction element with Square Indentations | Corrugated Construction Element 100 |
| Lateral Deflection at | 4.2 mm | 3.81 mm | 3.6 mm |

Comparative Example 2

Figure 15B:
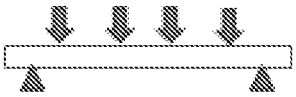
FIG. 15B demonstrates simulation of deflection under longitudinal load condition.
Figure 16:
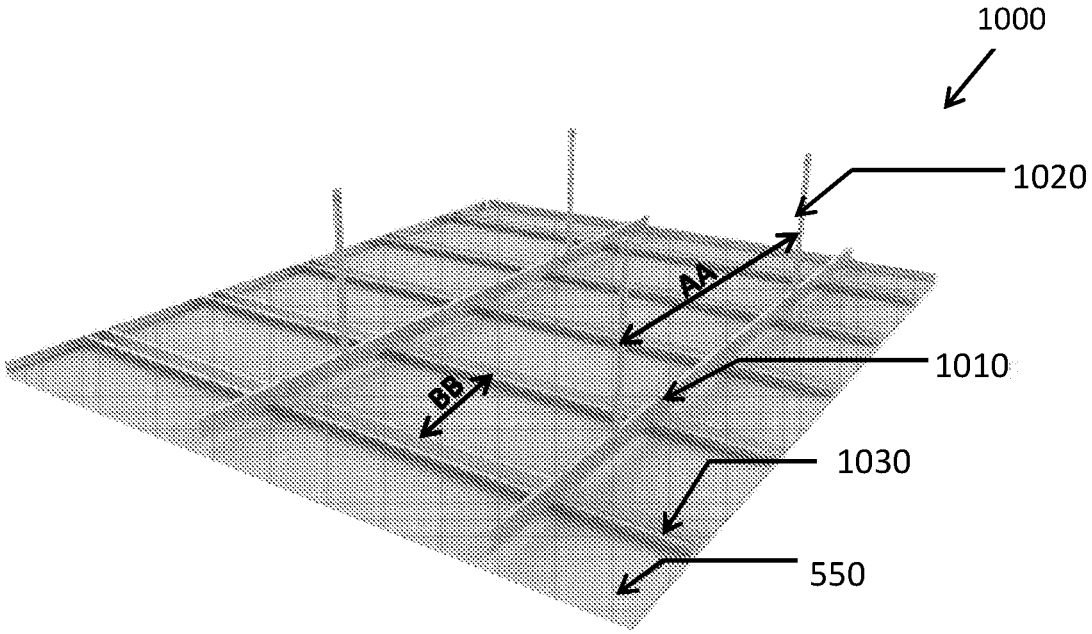
FIG. 16 illustrates a simulated ceiling system.

Simulations of deflection under longitudinal load condition (as shown in FIG. 15B), were compared for the three construction elements described above having a sample size of 1200 mm FIG. 16 depicts a simulated ceiling system. In the simulation, a suspended ceiling system 1000 comprised of intermediate channels 1010 suspended from ceiling angles 1020, where the spacing between consecutive ceiling angles 1020 was 1220 mm, measured from the center of one ceiling angle 1020 to the center of the next consecutive ceiling angle 1020 (as indicated in FIG. 16 by AA). In the simulation, ceilings sections 1030 were also fixed at 457 mm, measured from the center of one ceiling section 1030 to the center of the next consecutive ceiling section 1030 (as indicated in FIG. 16 by BB). The simulated suspended ceiling system 1000 was then loaded with 30 kg/m$^2$ and the load distribution on each of the ceiling system elements was measured to be 0.136 N/mm.

The results are shown in Table 2. The results showed that the corrugated construction element 100 of the present disclosure was stronger than the sections having square indentations but not as strong as construction elements having linear corrugations for ceiling constructions.

TABLE 2

| Deflection under Longitudinal Load Condition | | | |
|---|---|---|---|
| | Sample/Test Condition | | |
| | Construction Element with Linear Corrugations | Construction element with Square Indentations | Corrugated Construction Element 100 |
| Longitudinal Deflection at | 2.95 mm | 3.67 mm | 3.25 mm |

Comparative Example 3

Figure 15C:
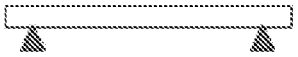
FIG. 15C demonstrates simulation of deflection due to self-weight.

Deflection of the 1200 mm corrugated construction element 100 of the present disclosure due to self-weight, as shown in FIG. 15C was simulated and compared with simulation values of 1200 mm construction elements having linear corrugations and sections having small square indentations covering the entire surface of the section. The results are shown in Table 3.

TABLE 3

| Deflection due to Self-Weight | | | |
|---|---|---|---|
| | Sample/Test Condition | | |
| | Construction Element with Linear Corrugations | Construction element with Square Indentations | Corrugated Construction Element 100 |
| Deflection due to self-weight | 0.034 mm | 0.038 mm | 0.035 mm |

The above results show that though construction elements with linear corrugations are stronger to longitudinal deflection and deflection due to self-weight, the corrugated construction element 100 of the present disclosure is strongest when subjected to lateral deflection that may cause the leg profiles 102*a*, 102*b* to collapse while the construction board is being screwed to the frame and may lead to instability of the construction.

Comparative Example 4

A construction element comprising square indentations and a corrugated construction element 100 of the present disclosure were placed vertically on an UTM machine and were applied with different loads. The maximum load at which the construction elements axially buckled was recorded. The results are shown in Table 4. The corrugated construction element 100 of the present disclosure axially buckled at a load of 9.20 kN which was much higher compared to the construction element with square Indentations.

TABLE 4

| Axial Buckling | | |
|---|---|---|
| | Sample/Test Condition | |
| | Construction element with Square Indentations | Corrugated Construction Element 100 |
| Maximum load at which axial buckling occurred (kN) | 6.87 | 9.20 |

Comparative Example 5

Three-point bending test was performed for the construction element comprising square indentations and a corrugated construction element 100 of the present disclosure by screwing together the base profiles of a pair of each of the construction elements using metal screws. A load of 1 kN was applied on the construction element comprising square indentations and a deflection of 16 mm was observed. Then the corrugated construction element 100 of the present disclosure was applied with load until a 16 mm deflection was detected. It was found that a 16 mm deflection appeared on the corrugated construction element 100 at a load of 1.2 kN. This showed the corrugated construction element 100 of the present disclosure to have 20% increased load bearing capacity.

Comparative Example 6

The shear strength of the corrugated construction element 100 of the present disclosure was measured and compared with the shear strength of the construction element comprising square indentations. The corrugated construction element 100 was found to withstand a load of 2.11 kN while the construction element comprising square indentations was found to take up a load of only 2.05 kN. Hence the improved shear strength of the corrugated construction element 100 of the present disclosure was illustrated.

INDUSTRIAL APPLICABILITY

With the implementation of the corrugated construction elements 100 of the present disclosure, quality issues associated with construction elements such as flange deflection, deflection due to self-weight, twisting and bending may be avoided. Further, using of these corrugated construction elements also increase the screw retention property and load bearing capacity of the construction elements. The array of the angular corrugations 110 provide for interlocking of vertically disposed corrugated construction elements 100 between the floor channel 520 and ceiling channel 530.

The invention also relates to a method of forming a corrugated profile 770 comprising an array of angular corrugations 110 extending across at least 25% of the surface of the sheet material 700. The method involves passing the flat sheet material 700 between the first roller 610 and second roller 620. The sheet material 700 is pressed against the V-grooves 120 present on the corrugation regions (630*a*, 630*b*, 640*a*, 640*b*) of the first roller 610 and second roller 620.

Note that not all of the activities described above in the general description or the examples are required, that a portion of a specific activity may not be required, and that one or more further activities may be performed in addition to those described. Still further, the order in which activities are listed is not necessarily the order in which they are performed.

Benefits, other advantages, and solutions to problems have been described above with regard to specific embodiments. However, the benefits, advantages, solutions to problems, and any feature(s) that may cause any benefit, advantage, or solution to occur or become more pronounced are not to be construed as a critical, required, or essential feature of any or all the claims.

The specification and illustrations of the embodiments described herein are intended to provide a general understanding of the structure of the various embodiments. The specification and illustrations are not intended to serve as an exhaustive and comprehensive description of all of the elements and features of apparatus and systems that use the structures or methods described herein. Certain features, that are for clarity, described herein in the context of separate embodiments, may also be provided in combination in a single embodiment. Conversely, various features that are, for brevity, described in the context of a single embodiment, may also be provided separately or in a sub combination. Further, reference to values stated in ranges includes each and every value within that range. Many other embodiments may be apparent to skilled artisans only after reading this specification. Other embodiments may be used and derived from the disclosure, such that a structural substitution, logical substitution, or another change may be made without departing from the scope of the disclosure. Accordingly, the disclosure is to be regarded as illustrative rather than restrictive.

The description in combination with the figures is provided to assist in understanding the teachings disclosed herein, is provided to assist in describing the teachings, and should not be interpreted as a limitation on the scope or applicability of the teachings. However, other teachings can certainly be used in this application.

As used herein, the terms "comprises," "comprising," "includes," "including," "has," "having" or any other variation thereof, are intended to cover a non-exclusive inclusion. For example, a method, article, or apparatus that comprises a list of features is not necessarily limited only to those features but may include other features not expressly listed or inherent to such method, article, or apparatus. Further, unless expressly stated to the contrary, "or" refers to an inclusive-or and not to an exclusive-or. For example, a condition A or B is satisfied by any one of the following: A is true (or present) and B is false (or not present), A is false (or not present) and B is true (or present), and both A and B are true (or present).

Also, the use of "a" or "an" is employed to describe elements and components described herein. This is done merely for convenience and to give a general sense of the scope of the invention. This description should be read to include one or at least one and the singular also includes the plural, or vice versa, unless it is clear that it is meant otherwise. For example, when a single item is described herein, more than one item may be used in place of a single item. Similarly, where more than one item is described herein, a single item may be substituted for that more than one item.

Unless otherwise defined, all technical and scientific terms used herein have the same meaning as commonly understood by one of ordinary skill in the art to which this invention belongs. The materials, methods, and examples are illustrative only and not intended to be limiting. To the extent that certain details regarding specific materials and processing acts are not described, such details may include conventional approaches, which may be found in reference books and other sources within the manufacturing arts.

While aspects of the present disclosure have been particularly shown and described with reference to the embodiments above, it will be understood by those skilled in the art that various additional embodiments may be contemplated by the modification of the disclosed machines, systems and methods without departing from the spirit and scope of what is disclosed. Such embodiments should be understood to fall within the scope of the present disclosure as determined based upon the claims and any equivalents thereof.

LIST OF ELEMENTS

Title: A Corrugated Construction Element

100 Corrugated Construction Element
101 Base Profile
102*a* First Leg Profile
102*b* Second Leg Profile
110 Array of Angular Corrugations
120 V-groove
130 Longitudinal Bead
140 Peak of the V-groove
150 Trough of the V-groove
160*a* Inward Flange Profile of First Leg Profile 102*a*
160*b* Inward Flange Profile of Second Leg Profile 102*b*
170*a* Outward Flange Profile of First Leg Profile 102*a*
170*b* Outward Flange Profile of Second Leg Profile 102*b*
200 Rectangular Construction Element
500 Wall
510 Frame
520 Floor Channel
530 Ceiling Channel
550 Construction Boards
600 Apparatus
610 First Roller
620 Second Roller
630*a* First Corrugation Region
630*b* Third Corrugation Region
640*a* Second Corrugation Region
640*b* Fourth Corrugation Region
700 Flat Sheet Material
770 Corrugated Profile
800 Method
900 Flat Portion
1000 Simulated Suspended Ceiling System
1010 Intermediate Channel
1020 Ceiling Angle
1030 Ceiling Section
D1 First set of Angular Corrugations
D2 Second set of Angular Corrugations
L Principal Axis of 100
P Pitch of the Angular Corrugation Array
H Height of the Angular Corrugation Array
G Height of Leg Profiles 102*a* and 102*b*
X Angle between D1 and D2
Y Angle between Array of Angular Corrugation and Principal Axis L
Z Opening Angle
AA Distance between Two Consecutive Ceiling Angles
BB Distance between Two Consecutive Ceiling Sections

We claim:

1. A corrugated construcvtin element formed from a sheet of material and having a base profile connected to at leat one leg profile, comprising at least two arrays of angular corrugations extending across their surface in a non-parallel direction to the principal axis L of the corrugated constructin element covering a surface area greater than 50% and less than or equal to 100% of the total surface area of the corrugated construction element, thereby increasing the effective thickness of the corrugated construction element with respect to the sheet of material from which it is formed, wherein the array of angular corrugations on the at least one leg profile extends at an angle Y ranging between 15° and 75° with respect to the to the principal axis L of the corrugated construction element, wherein the array of angular corrugations comprise at least one first array of angular corrugations and at least one second array of angular corrugations having an angle X therebetween ranging from 30 to 150 degrees, and wherein each array of angular corrugations is a series of continuously alternating peaks and troughs, wherein the peaks and the troughts each extend from the surface of the construction element, each peak and each trough being a V-shaped groove.

2. The corrugated construction element as claimed in claim 1, wherein the at least two arrays of angular corrugations cover a surface area greater than 50% and less than 75% of the total surface area of the corrugated construction element.

3. The corrugated construction element as claimed in claim 1, wherein a bottom of each V-shaped groove is curved or pointed.

4. The corrugated construction element as claimed in claim 1, wherein first array of angular corrugations and the second array of angular corrugations run in opposite directions from the edges of corrugation construction element meeting at angle X to form the array of V-shaped annular corrugations.

5. The corrugated construction element as claimed in claim 1, wherein the at least one leg profile, is non-coplanar to the base profile.

6. The corrugated construction element as claimed in claim 1, wherein each of the peaks and troughs are sharp, blunt or curved.

7. The corrugated construction element as claimed in claim 1, wherein each array of angular corrugations has a pitch P distance two consecutive peaks or troughs ranging between 2 mm and 6 mm.

8. The corrugated construction element as claimed in claim 1, wherein one or more V-shaped cross sections of each array of angular corrugations has a height H ranging between 0.1 mm and 1 mm.

9. The corrugated construction element as claimed in claim 1, wherein the first leg profile includes a first leg profile and a second leg profile which have different heights from each other such that two identical corrugated construction elements can be joined to form a rectangular corrugated construction element.

10. A wall construction comprising:

a frame comprising:

a plurality of corrugated construction elements as claimed in claim 1;

a floor channel configured to receive a first end of each of the plurality of corrugated construction elements; and a ceiling channel spaced apart from the floor channel, wherein the ceiling channel is configured to receive a second end opposite to the first end of each of the corrugated construction elements in a horizontal plane, wherein the floor channel and the ceiling channel are made from the corrugated construction elements and wherein the plurality of corrugated construction elements are vertically and/or horizontally disposed at a predetermined distance between the floor channel and the ceiling channel.

11. An apparatus for forming a sheet material into a profile comprising an array of angular corrugations extending across at least 25% of the surface of the profile of the corrugation construction element as claimed in claim 1, the apparatus comprising:

a first roller comprising:

a first corrugation region for forming one part of a first set of angular corrugations, and a second corrugation region for forming one part of a second set of angular corrugations; and a second roller comprising:

a third corrugation region for forming the other part of the first set of angular corrugations, and a fourth corrugation region for forming the other part of the second set of angular corrugations;

wherein the first roller and second roller are configured to mate with each other and wherein the angle between the first set of angular corrugations and the second set of angular corrugations ranges between 30-150 degrees.

12. The apparatus as claimed in claim 11, wherein the first and third corrugation regions are co-operable and consist of V-shaped grooves that correspond with each other.

13. The apparatus as claimed in claim 11, wherein the second and fourth corrugation regions are co-operable and consist of V-shaped grooves that correspond with each other.

14. A method of manufacturing a profile comprising an array of angular corrugations extending across at least 25% of the surface of the profile of a corrugation construction element as claimed in claim 1, the method comprising providing an a apparatus comprising:

a first roller comprising:

a first corrugation region for forming one part of a first set of angular corrugations, and a second corrugation region for forming one part of a second set of angular corrugations; and a second roller comprising:

a third corrugation region for forming the other part of the first set of angular corrugations, and a fourth corrugation region for forming the other part of the second set of angular corrugations;

wherein the first roller and second roller are configured to mate with each other and wherein the angle between the first set of angular corrugations and the second set of angular corrugations ranges between 30-150 degrees; and passing a sheet material between the first roller and second roller of the apparatus, wherein the sheet is pressed against the V-shaped grooves present in the corrugation regions of the first roller and second roller.

15. The corrugated construction element as claimed in claim 1, wherein the two or more arrays of angular corrugations cover a surface area greater than 75% of the total surface area of the corrugated construction element.

16. The corrugated construction element as claimed in claim 1, wherein each array of angular corrugations has a pitch P distance between two consecutive peaks or troughs ranging between 2 mm and 6 mm, and wherein one or mnore V-shaped cross sections of each array of angular corrugations has a height H ranging between 0.1 mm and 1 mm.

17. The corrugated construction element as clained in claim 1, wherein the array of angular corrugations cover a surface area greater than 75% of the total surface area of the corrugated construction element and the array of angular corrugations has a pitch P distance between two consecutive peaks or troughs ranging between 2 mm and 6 mm.

18. The corrugated construction element as claimed in claim 1, wherein the first array of corrugations is disposed on both the base profile and a first leg profile, and the second array of corrugations is disposed on both the base profile and a second leg profile.

* * * * *